US005465529A

United States Patent [19]

Park

[11] Patent Number: 5,465,529

[45] Date of Patent: Nov. 14, 1995

[54] SUPPORT STAND FOR DECORATIVE TREE

[76] Inventor: Chaan-Kyung Park, JuKong Apt. 1110-507, SunBu-Dong, AnSan-City, KyungKi-Do, Rep. of Korea

[21] Appl. No.: 274,864

[22] Filed: Jul. 14, 1994

[51] Int. Cl.[6] ..... A47G 7/02

[52] U.S. Cl. ..... 47/40.5; 248/524; 248/525

[58] Field of Search ..... 47/40.5; 248/525, 248/523, 524, 519, 529

[56] References Cited

U.S. PATENT DOCUMENTS

| | | | |
|---|---|---|---|
| 952,655 | 3/1910 | Wagner | 248/524 |
| 2,448,304 | 8/1948 | Gabel | 47/40.5 |
| 2,899,156 | 8/1959 | Marcucci | 248/524 |
| 3,231,226 | 1/1966 | Rossler | 248/524 |
| 4,825,856 | 5/1989 | Coppedge | 248/529 |

*Primary Examiner*—Henry E. Raduazo

*Attorney, Agent, or Firm*—Fitzpatrick, Cella, Harper & Scinto

[57] ABSTRACT

Outdoor or indoor stand for supporting decorative trees, such as Christmas trees. In this stand, the bottom of a tree trunk is inserted into a cylindrical support vessel medially and orthogonally mounted on the top surface of a base plate. The lower and upper portions of the tree trunk are held by first and second abutment portions. Each of the first and second abutment portions and a support arm portion comprises three members that are separately produced but assembled into and handled in a unit. The stand prevents possible sway of the tree such as due to outside impact, firmly supports any thickness of tree trunk and achieves easiness to handle.

3 Claims, 3 Drawing Sheets

SUPPORT STAND FOR DECORATIVE TREE

BACKGROUND OF THE INVENTION

1. Field of the Invention

The present invention relates in general to outdoor or indoor stands for supporting decorative trees, such as Christmas trees, and, more particularly, to structural improvement in such tree support stands for inserting a tree trunk into a cylindrical support vessel medially and orthogonally mounted on the top surface of a base plate and double holding lower and upper portions of the tree trunk by first and second abutment portions, thus to prevent possible sway of the tree such as due to outside impact, to firmly support the tree, readily support any thickness of tree trunk and to achieve easiness to handle.

2. Description of the Prior Art

Conventionally, there have been proposed and used support stands for supporting outdoor or indoor decorative trees such as Christmas trees. The known tree support stands are classified into single holding type stands and double holding type stands. In a single holding type tree support stand, the decorative tree is held or supported merely at its trunk bottom. In a double holding type tree support stand, the decorative tree is intended to be held or supported not only at the upper portion of the tree trunk but also at the bottom of the tree trunk.

U.S. Pat. No. 4,007,901 discloses a double holding type tree support stand. In this tree support stand, a spike is provided in the bottom of a tree trunk receiving vessel to project upwardly from the vessel bottom and into a decorative tree trunk that is inserted into the vessel. In order to additionally hold the upper portion of the trunk of the decorative tree, a partial collar is fixed to and extends transversely of the inwardly extending portion of an arm of a support member, which support member in turn is pivotally connected to an extension of a generally Y-shaped base. This Y-shaped base is adapted for supporting the tree trunk receiving vessel thereon. However, this stand has a problem in that the stand is structurally unstable since the tree trunk receiving vessel is merely supported on the Y-shaped base. The spike of the vessel bottom projects into the tree trunk that is inserted into the vessel, so that the stand exhibits barely weak structural force for supporting the decorative tree. Another problem of the above tree support stand is resided in that each support member, which is pivotally connected to the extension of the Y-shaped base and comprises a leg portion and the arm, is such thin that the tree support stand is apt to fall even by a weak outside impact.

U.S. Pat. No. 5,249,772 discloses another tree support stand of the double holding type. This tree support stand, however, has a problem in that this stand somewhat troubles a user since the tree to be supported by the stand should be received in an inner portion and, thereafter, received in a base portion together with the inner portion, which inner portion is securable in the base portion by a securing assembly. A clamp portion should be adjusted in accordance with thickness of tree, however, such adjustment of the clamp portion is very difficult. Furthermore, the tree support stand may not stand a big tree due to its structural weakness. Another problem of the above tree support stand is resided in that the base portion, comprising a frusto-conical sidewall portion, an upper rim and a bottom wall, and a plurality of securing arms of the securing assembly should be separately produced with high cost. Such separate production of the base portion and the securing arms also complicates the production process of the stand.

U.S. Pat. Nos. 4,436,272, 5,209,450 and 4,825,586 disclose single holding type tree support stands respectively. However, each of those tree support stands merely supports the bottom of the tree trunk, so that each tree support stand can not firmly support the tree on its base when the tree is thick, tall and/or decorated with ornaments.

U.S. Pat. No. 5,159,780 discloses a tree support stand that includes a flexible circular collar joined to a plurality of two piece adjustable elongated support members. The flexible circular collar is axially provided with a plurality of snap protrusions at one end thereof and with a plurality of snap holes at the other end thereof. When supporting a tree, the diameter of the flexible circular collar should be adjusted in accordance with thickness of the tree by moving the snap protrusions with respect to the snap holes, so that the tree trunk may be tightly supported. However, this tree support stand has a problem in that the engagement of the snap protrusions with their snap holes may be loosened because of long time use of the stand and, as a result, the protrusions may be easily suddenly separated from their snap holes. Furthermore, the snap protrusions should be forcibly inserted into associated snap holes one by one and this causes considerable inconvenience in the use of the stand.

As described above, the known tree support stands of the single holding type or of the double holding type, while intending to firmly support decorative trees, nevertheless have problems. That is, each of the known single holding type support stands is not suitable for used with either tall or thick tree, thus to be scarcely used. Each of the known double holding type support stands not only troubles the user handling the stand but also has an integrated structure which may cause the stand to be produced through a complicated process with high cost.

SUMMARY OF THE INVENTION

It is, therefore, an object of the present invention to provide a support stand for a decorative tree in which the above problems can be overcome and which receives the bottom of tree trunk in a cylindrical vessel mounted fixedly and medially on a base plate and double holds lower and upper portions of the tree trunk by first and second abutment portions, otherwise stated, which tree support stand supports the tree using the base plate as well as the first and second abutment portions assembled with the base plate into the stand of a single body, thus to firmly support the decorative tree while preventing possible sway of the tree such as due to outside impact.

It is another object of the present invention to provide a support stand for a decorative tree of which the first and second abutment portions each comprises three members that are separately produced but united into and handled in a unit when used for holding a tree trunk, so that the first and second abutment portions can be adjusted in accordance with thickness of the tree trunk and readily support any thickness of tree trunk, and the adjustment of the first and second abutment portions is easily achieved by screw motions suitable for giving a convenience to a user who handles the stand.

It is still another object of the present invention to provide a stable support stand for a decorative tree whose first and second abutment portions, elongated support arms and base plate are separately produced but selectively assembled into the stand when used for supporting a decorative tree, thus to firmly support any size of tree, and which stand is readily produced, thus to not only improve the productivity but also reduce production cost.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
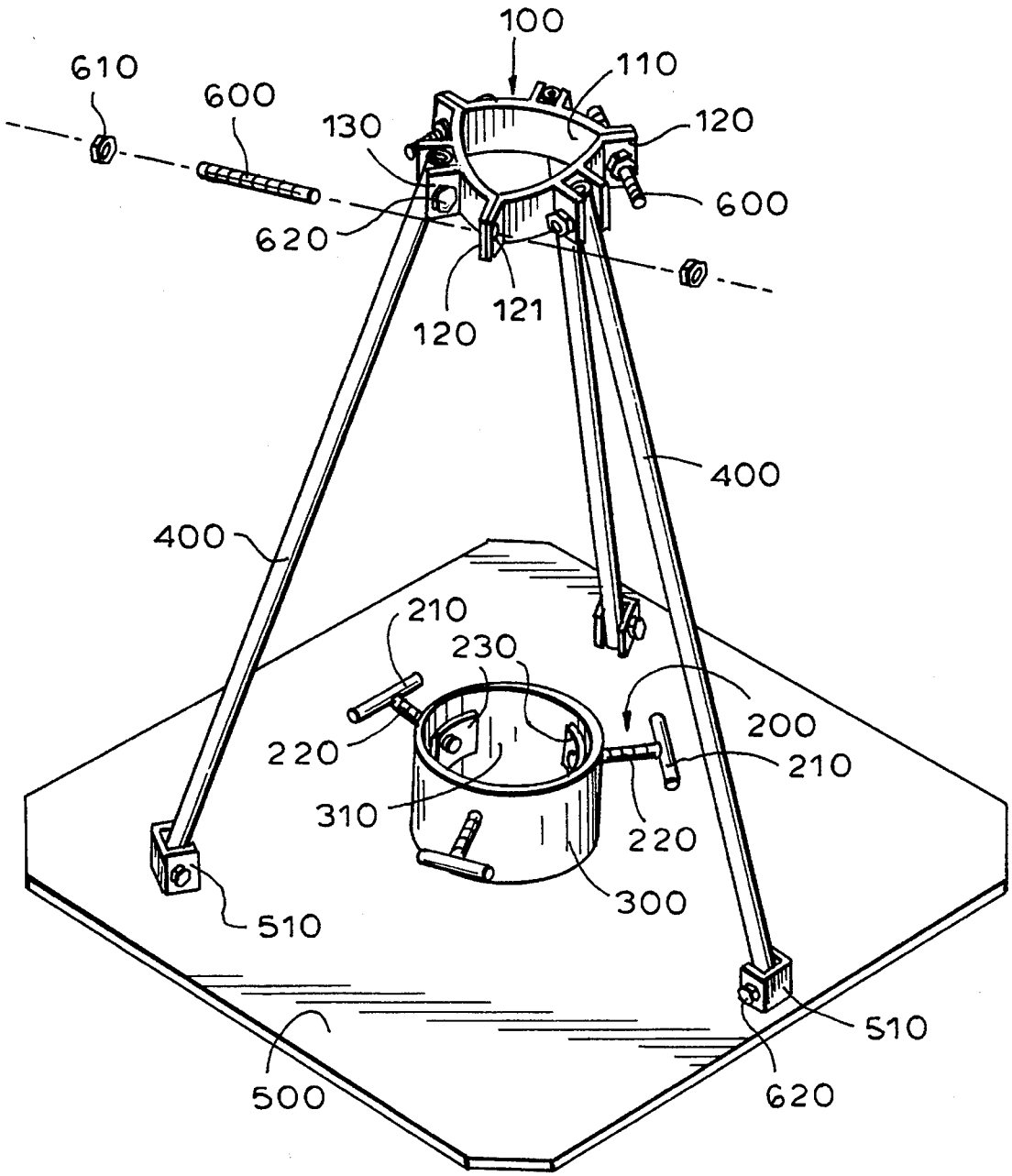
FIG. 1 is a perspective view of a support stand for a decorative tree in accordance with a preferred embodiment of the present invention, showing a bolt and associated nuts separated from associated bolt receiving holes of bent parts of second abutment members.
Figure 2:
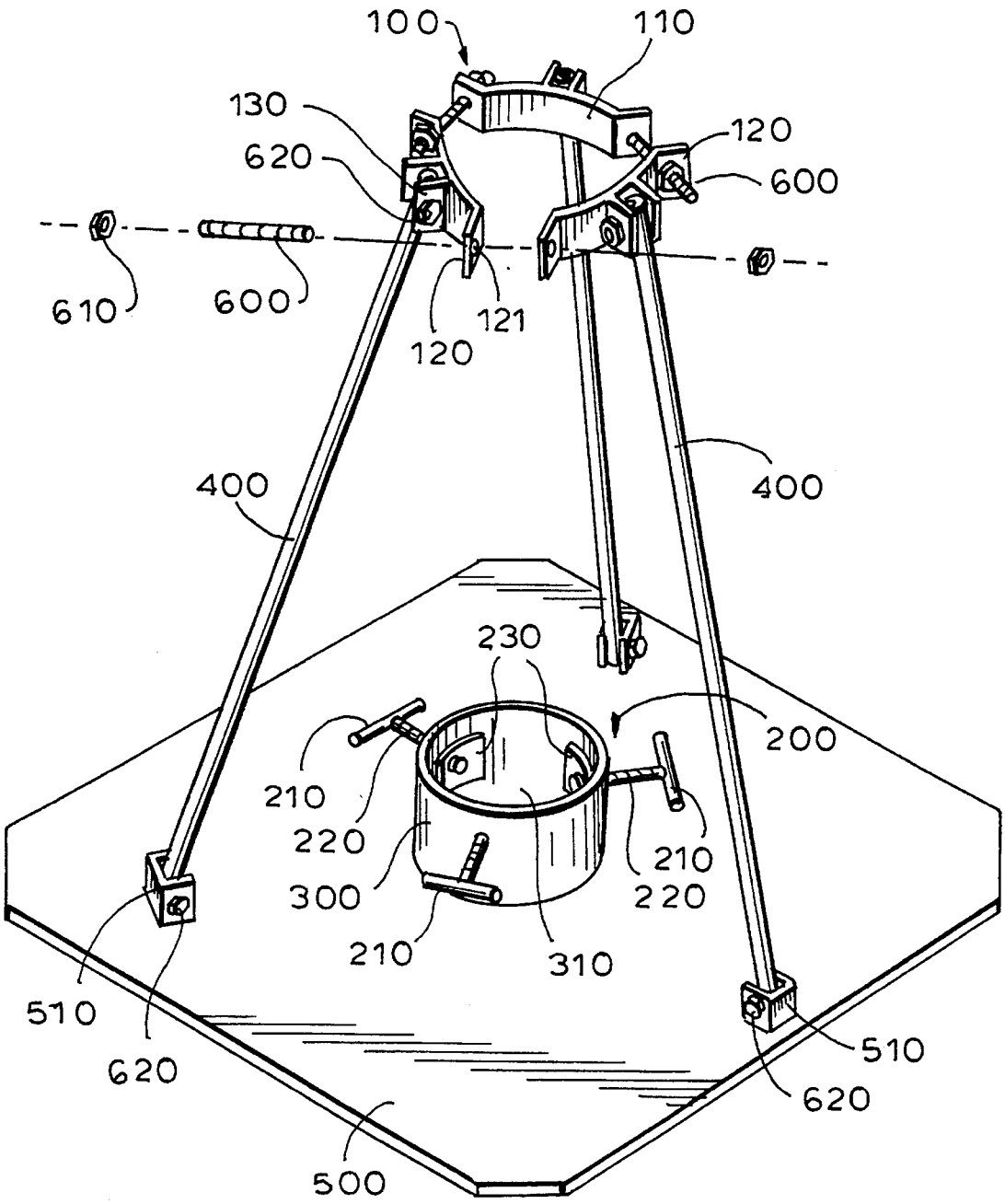
FIG. 2 is a perspective view of the support stand of FIG. 1, showing both the second abutment members and elongated support arms which are adjusted so as to support a thickness of tree trunk.
Figure 3:
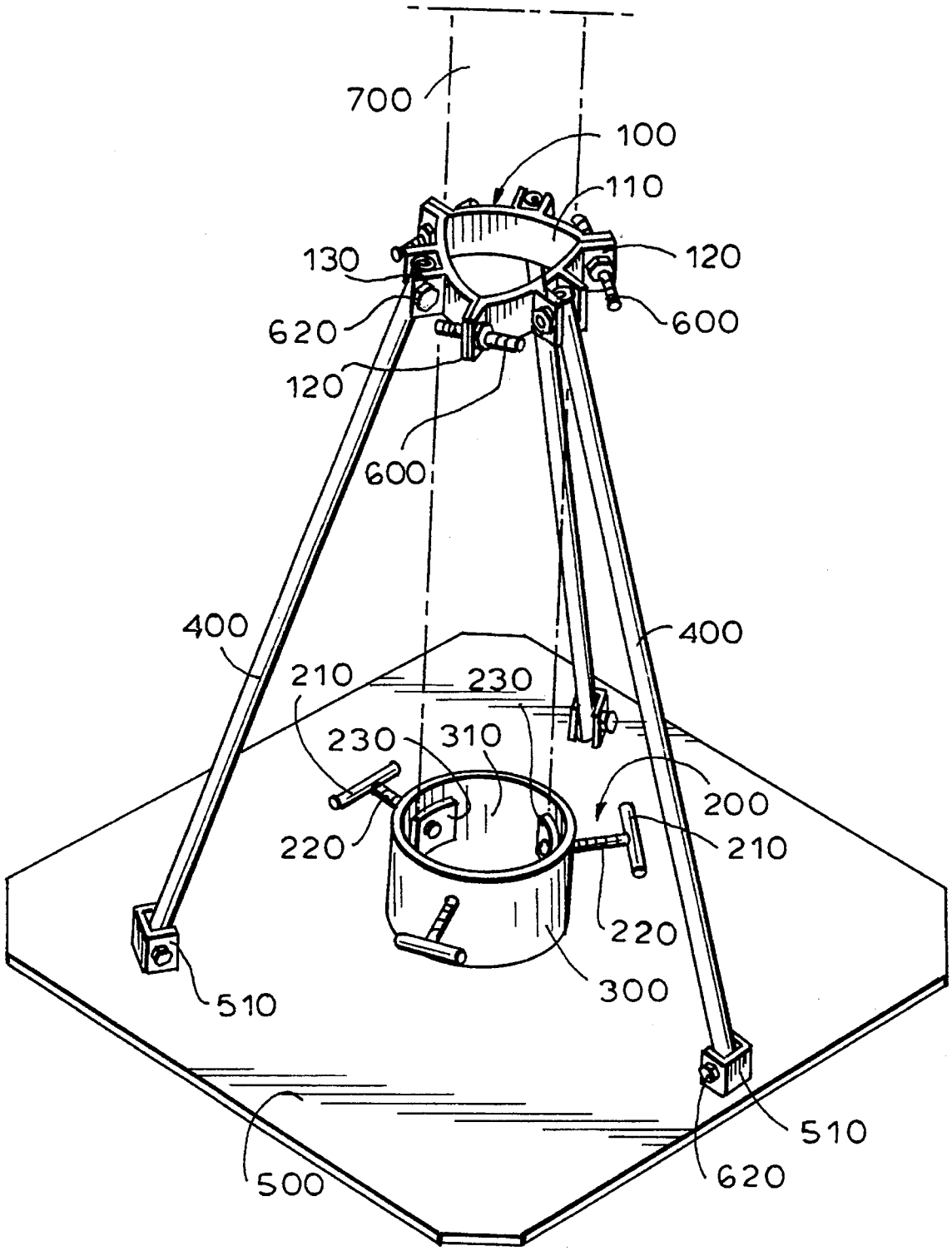
FIG. 3 is a perspective view of the support stand of FIG. 1, with the tree trunk shown in phantom lines and double held by first and second abutment portions at its lower and upper portions.

With reference to the drawings, FIG. 1 is a perspective view of a tree support stand in accordance with a preferred embodiment of the present invention, particularly showing a bolt and associated nuts separated from associated bolt receiving holes of bent parts of second abutment members. FIG. 2 is a perspective view of the tree support stand of FIG. 1, particularly showing both the second abutment members and elongated support arms which are adjusted so as to support a thickness of tree trunk. FIG. 3 is a perspective view of the support stand of FIG. 1, with the tree trunk shown in phantom lines and double held by first and second abutment portions at its lower and upper portions.

As shown in the drawings, the tree support stand of this invention includes a predetermined size of base plate designated by the numeral 500. When using the tree support stand, the base plate 500 will be placed on the bottom and functions as a base of the stand. Medially and orthogonally mounted on the top surface of the base plate 500 is a cylindrical support vessel 300 that is to receive and support the bottom portion of a tree trunk 700. This support vessel 300 is opened upwardly so as to form a tree trunk cavity 310. The first abutment portion includes a plurality of first abutment members 200 that are provided on the side wall of the support vessel 300. Each first abutment member 200 includes a threaded rod 220 radially threadedly penetrating its associated side wall of the support vessel 300. Each threaded rod 220 includes a predetermined size of abutment collar 230 mounted on an interior end of each threaded rod 220 within the support vessel 300. Mounted on an exterior end of each threaded rod 220 out of the support vessel 300 is a rod handle 210 for manual rotation of the threaded rod 220 and for radial movement of the abutment collar 230 with respect to its associated outer surface of the tree trunk 700. The support arm portion comprises a plurality of regularly spaced and elongated support arms 400 that are pivotally connected, at their lower ends, to hinge mounts 510 mounted on the top surface of the base plate 500. The hinge mounts 510 are arranged on the base plate 500 in such a manner that they are spaced out at regular intervals. Each support arm 400 is readily movable at its lower end that is pivotally connected to its associated hinge mount 510 of the base plate 500, so that the tree support stand of this invention selectively supports trees of different thicknesses. This tree support stand double holds the tree trunk 700 by the first and second abutment portions. The second abutment portion, which intends to hold an upper portion of the tree trunk 700, includes a plurality of second abutment members 100. Each second abutment member 100 includes an abutment collar 110 that has a center extension mount 130. Each center extension mount 130 pivotally connects a top end of its associated support arm 400 to each second abutment member 100. The second abutment members 100 are also connected to each other by bolts 600 and nuts 610 and come into close contact with and tightly hold the upper portion of the tree trunk 700 when tightening the bolts 600 and nuts 610.

In order to not only reduce the cost for material of the tree support stand but also firmly support the tree trunk 700, each of the first abutment portion, the second abutment portion and the support arm portion of the tree support stand according to the preferred embodiment of this invention comprises three members that are separately produced but assembled into and handled in a unit when the stand is used for supporting a tree trunk.

In the preferred embodiment, each abutment collar 110, 230 of the first and second abutment members 200 and 100 is partially cylindrically shaped so as to correspond to a cylindrical outer surface of the tree trunk 700. With the partially cylindrical shape of each abutment collar 110, 230, each abutment collar 110, 230 comes into close contact with the cylindrical outer surface of the tree trunk 700. However, it should be understood that there exist a variety of different collar configurations which yield the same result as that described for the preferred embodiment without affecting the functioning of this invention.

Each abutment member 100 of the second abutment portion has a predetermined length and is bent outwardly at its opposed sides, thus to form opposed bent parts 120. Each bent part 120 has a hole 121 for receiving its associated bolt 600, which bolts 600 in turn are tightened by nuts 610. The second abutment portion including the three abutment members 100 will be thus readily adjusted so as to hold the upper portion of any thickness of tree trunk.

Please noted that the elements, that is, the first and second abutment members 200 and 100, the support arms 400 and the support vessel mounted base plate 500 and the like, of the tree support stand of this invention may be constructed of a material, for example, metal or synthetic resin, that is able to achieve the intended operational effect of the present invention.

In the drawing, the reference numerals 620 denote hinge shafts that pivotally connect opposed ends of the support arms 400 to the hinge mounts 510 and to the center extension mounts 130 respectively.

When assembling the above elements, that is, the first and second abutment members 200 and 100, the support arms 400 and the base plate 500 and the like, into the tree support stand, the lower ends of the elongated support arms 400 are pivotally connected to their associated hinge mounts 510 the support vessel base plate 500 using associated hinge shafts 620 as shown in FIG. 1. At this time, the base plate 500 is also provided with the cylindrical support vessel having the first abutment members 200. The elongated support arms 400 are, thereafter, pivotally connected, at their ends, to their associated center extension mounts 130 of second abutment members 100 using associated hinge shafts The second abutment members 100 of the second abutment portion in turn are connected to each other by bolts 600 and nuts 610.

At this time, the bolts 600 are inserted into the bolt holes 121 of the bent parts 120 of the abutment collars 110 and tightened by the nuts 610 on opposed ends thereof.

When using the tree support stand with the tree trunk 700, the rod handles 210 of the first abutment members 200 are turned in a direction that threadedly retracts the threaded rods 220 along with their associated abutment collars 230 from the orthogonal center axis of the cylindrical support vessel 300 as shown in FIGS. 2 and 3, thus to cause the abutment collars 230 to be retracted and more spaced out while defining a space for readily accommodating the tree trunk 700. At this time, it is preferred to adjust the abutment collars 230 of the first abutment members 200 to make the space inside the abutment collars 230 have a diameter larger than the thickness of the tree trunk 700 to be received in the space. The tree trunk 700 will be thus readily accommodated in the space.

The nuts 610 are appropriately loosened so as to allow the abutment collars 110 of the second abutment members 100 to be more spaced out and to define a space receivable the tree trunk 700.

After adjusting the first and second abutment members 200 and 100 so as to define the spaces whose diameters are larger than the thickness of the tree trunk 700, the tree trunk 700 passes through the space inside the abutment collars 110 of the second abutment members 100. The bottom of the tree trunk 700 is, thereafter, inserted into the space inside the abutment collars 230 of the first abutment members 200 within the trunk cavity 310 of the cylindrical support vessel 300. The rod handles 210 are turned with balance in reverse direction that threadedly advances the threaded rods 220 along with the abutment collars 230 to the center orthogonal axis of the vessel 300. The abutment collars 230 thus come into close contact with and suppress the outer surface of the bottom of the tree trunk 700, which trunk 700 is orthogonally and concentrically erected on the base plate 500 within the vessel 300. The nuts 610 are, thereafter, tightened, thereby causing the second abutment members 100 to tightly hold the upper portion of the tree trunk 700. With the bolts 600 and nuts 610, adjustment of the second abutment members 100 for holding the upper portion of the tree trunk 700 is more facilitated.

When keeping the tree trunk stand for subsequent use in a following year, the above procedure is repeated in reverse manner. Otherwise stated, the tree trunk 700 is removed from the stand prior to disassembling of the stand into the elements, that is, the first and second abutment members 200 and 100, the elongated support arms 400, the support vessel mounted base plate 500 and the like. This permits ease of reuse and maintenance of the stand for subsequent use in a following year.

As described above, the tree support stand of the present invention receives the bottom of a decorative tree trunk in a trunk cavity of a support vessel medially mounted on the top surface of a base plate and, thereafter, double holds lower and upper portions of the tree trunk using first and second abutment portions, thus to prevent possible sway of the tree trunk such as due to outside impact and to firmly support the tree trunk.

The first and second abutment portions of the tree support stand of this invention each comprises three members that are separately produced but assembled into and handled in a unit when the stand is to support a decorative tree. The first and second abutment portions can be thus readily adjusted in accordance with the thickness of tree trunk, so that the tree support stand can support any thickness of tree trunk. Since the first and second abutment portions are adjusted by screw motions suitable for achieving easiness to handle, the tree support stand gives a convenience to a user who handles the stand.

The first and second abutment portions, the elongated support arms and the base plate are separately produced but assembled into the stand when the stand is to support a decorative tree, so that the stand of this invention is readily produced, improves the productivity and reduces production cost.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A support stand for a decorative tree comprising:

a predetermined size of base plate, said base plate having a plurality of hinge mounts, said hinge mounts being mounted on a top surface of said base plate and spaced out at regular intervals;

a cylindrical support vessel for receiving and supporting a bottom of a tree trunk, said support vessel being medially mounted on the top surface of said base plate and opened upwardly so as to define a trunk cavity therein;

a first abutment portion including a plurality of first abutment members, each first abutment member being provided on the side wall of said support vessel and including a threaded rod threadedly penetrating the side wall of the vessel, a predetermined size of abutment collar mounted on an interior end of the threaded rod, and a rod handle mounted on an exterior end of the threaded rod, said rod handle being adapted for manual rotation of the threaded rod and for radial movement of the abutment collar with respect to its associated outer surface of the tree trunk;

a support arm portion including a plurality of support arms, each support arm being pivotally connected, at its lower end, to its associated hinge mount of the base plate; and a second abutment portion including a plurality of second abutment members, each second abutment member including an abutment collar having a center extension mount, said extension mount pivotally connecting a top end of its associated support arm to each second abutment member, and said second abutment members being also connected to each other by bolts and nuts and coming into close contact with and tightly holding an upper portion of said tree trunk by tightening said bolts and nuts.

2. A support stand for a decorative tree as set forth in claim 1, wherein each of said first abutment portion, said second abutment portion and said support arm portion comprises three members that are separately produced but assembled into and handled in a unit, and each abutment collar of the first and second abutment portions is partially cylindrically shaped so as to correspond to an outer surface of the tree trunk.

3. A support stand for a decorative tree as set forth in claim 1 or 2, wherein each abutment member of said second abutment portion has a predetermined length and is bent outwardly at its opposed sides so as to form opposed bent parts, each bent part having a hole for receiving its associated bolt.

* * * * *